US006106089A

United States Patent [19]

Wen et al.

[11] Patent Number: 6,106,089

[45] Date of Patent: Aug. 22, 2000

[54] MAGNETIC SENSOR FOR INK DETECTION

[75] Inventors: Xin Wen, Rochester, N.Y.; Frederick R. Chamberlain, IV, Encinitas, Calif.

[73] Assignee: Eastman Kodak Company, Rochester, N.Y.

[21] Appl. No.: 08/958,274

[22] Filed: Oct. 27, 1997

Related U.S. Application Data

[63] Continuation-in-part of application No. 08/846,923, Apr. 30, 1997, abandoned, which is a continuation-in-part of application No. 08/846,693, Apr. 30, 1997, Pat. No. 5,792,380.

[51] Int. Cl.[7] ..... B41J 2/17

[52] U.S. Cl. ..... 347/7; 347/100

[58] Field of Search ..... 347/6, 7, 100; 399/12; 324/204, 235, 239; 73/61.42; 101/DIG. 45; 106/31.32, 31.64, 31.92

[56] References Cited

U.S. PATENT DOCUMENTS

| | | | |
|---|---|---|---|
| 3,946,398 | 3/1976 | Kyser et al. . | |
| 4,166,277 | 8/1979 | Cielo et al. . | |
| 4,275,290 | 6/1981 | Cielo et al. . | |
| 4,405,370 | 9/1983 | Soga et al. . | |
| 4,490,728 | 12/1984 | Vaught et al. . | |
| 4,751,531 | 6/1988 | Saito et al. . | |
| 4,963,939 | 10/1990 | Kurando et al. | 399/12 |
| 5,250,957 | 10/1993 | Onozato . | |
| 5,506,079 | 4/1996 | Grigoryan et al. . | |
| 5,541,632 | 7/1996 | Khodapanah et al. . | |
| 5,557,310 | 9/1996 | Kurata et al. . | |
| 5,599,578 | 2/1997 | Butland | 427/7 |
| 5,610,518 | 3/1997 | Chanberlain, IV | 324/235 |
| 5,682,184 | 10/1997 | Stephany et al. | 347/7 |

FOREIGN PATENT DOCUMENTS

| | | |
|---|---|---|
| 0 745 481 | 4/1996 | European Pat. Off. . |
| 0 745 482 | 4/1996 | European Pat. Off. . |
| 6-348389 | 12/1994 | Japan . |
| 2007162 | 10/1982 | United Kingdom . |

OTHER PUBLICATIONS

Johnson, J.E. and Belmont, J.A., Novel Black Pigment for Ink Jet Ink Applications, *Recent Progress in Ink–Jet Technologies*, Society for Imaging Science and Technology, pp. 226–229.

*Primary Examiner*—Joan Pendergrass
*Attorney, Agent, or Firm*—William F. Noval

[57] ABSTRACT

An ink jet printing apparatus adapted to producing images using inks having predetermined concentrations of a magnetic label material therein, includes a printhead; an ink delivery system adapted to provide inks to the printhead; and a magnetic sensor associated with the ink delivery system, said sensor being sensitive to the magnetic label material in the ink and adapted to produce a signal which is characteristic of the concentration of the label material in the ink; wherein said magnetic sensor includes a horseshoe permanent magnet having first and second pole faces and a pair of magnetic field sensors located symmetrically between said pole faces having their axes of magnetic field sensitivity aligned perpendicular to the fixed field of said permanent magnet such that no signal is produced from said fixed field.

4 Claims, 3 Drawing Sheets

MAGNETIC SENSOR FOR INK DETECTION

CROSS REFERENCE TO RELATED APPLICATIONS

This application is a continuation-in-part of and claims the benefit under 35 USC 120 of the filing date of commonly assigned, copending U.S. patent application Ser. No. 08/846,923 entitled INK DELIVERY SYSTEM AND PROCESS FOR INK JET PRINTING APPARATUS, inventor Xin Wen, filed Apr. 30, 1997, abandoned; and U.S. patent application Ser. No. 08/846,693, entitled INK JET PRINTING INK COMPOSITION WITH DETECTABLE LABEL MATERIAL, inventors Xin Wen, et al., filed Apr. 30, 1997, now U.S. Pat. No. 5,792,380.

FIELD OF THE INVENTION

This invention relates generally to the field of digitally controlled ink transfer printing devices, and in particular to such devices comprising magnetic sensors for magnetic label materials contained in inks to be used therewith.

BACKGROUND OF THE INVENTION

Ink jet printing has become recognized as a prominent contender in the digitally controlled, electronic printing arena because, e.g., of its non-impact, low-noise characteristics, its use of plain paper and its avoidance of toner transfers and fixing. Ink jet printing mechanisms can be categorized as either continuous ink jet or drop-on-demand ink jet. U.S. Pat. No. 3,946,398, which issued to Kyser et al. in 1970, discloses a drop-on-demand ink jet printer which applies a high voltage to a piezoelectric crystal, causing the crystal to bend, applying pressure on an ink reservoir and jetting drops on demand. Other types of piezoelectric drop-on-demand printers utilize piezoelectric crystals in push mode, shear mode, and squeeze mode. Piezoelectric drop-on-demand printers have achieved commercial success at image resolutions up to 720 dpi for home and office printers. However, piezoelectric printing mechanisms usually require complex high voltage drive circuitry and bulky piezoelectric crystal arrays, which are disadvantageous in regard to manufacturability and performance.

Great Britain Patent No. 2,007,162, which issued to Endo et al. in 1979, discloses an electrothermal drop-on-demand ink jet printer which applies a power pulse to an electrothermal heater which is in thermal contact with water based ink in a nozzle. A small quantity of ink rapidly evaporates, forming a bubble which cause drops of ink to be ejected from small apertures along the edge of the heater substrate. This technology is known as Bubblejet™ (trademark of Canon K.K. of Japan).

U.S. Pat. No. 4,490,728, which issued to Vaught et al. in 1982, discloses an electrothermal drop ejection system which also operates by bubble formation to eject drops in a direction normal to the plane of the heater substrate. As used herein, the term "thermal ink jet" is used to refer to both this system and system commonly known as Bubblejet™.

Thermal ink jet printing typically requires a heater energy of approximately 20 $\mu$J over a period of approximately 2 $\mu$sec to heat the ink to a temperature between 280° C. and 400° C. to cause rapid, homogeneous formation of a bubble. The rapid bubble formation provides the momentum for drop ejection. The collapse of the bubble causes a tremendous pressure pulse on the thin film heater materials due to the implosion of the bubble. The high temperatures needed necessitates the use of special inks, complicates the driver electronics, and precipitates deterioration of heater elements. The 10 Watt active power consumption of each heater is one of many factors preventing the manufacture of low cost high speed pagewidth printheads.

U.S. Pat. No. 4,275,290, which issued to Cielo et al., discloses a liquid ink printing system in which ink is supplied to a reservoir at a predetermined pressure and retained in orifices by surface tension until the surface tension is reduced by heat from an electrically energized resistive heater, which causes ink to issue from the orifice and to thereby contact a paper receiver. This system requires that the ink be designed so as to exhibit a change, preferably large, in surface tension with temperature. The paper receiver must also be in close proximity to the orifice in order to separate the drop from the orifice.

U.S. Pat. No. 4,166,277, which also issued to Cielo et al., discloses a related liquid ink printing system in which ink is supplied to a reservoir at a predetermined pressure and retained in orifices by surface tension. The surface tension is overcome by the electrostatic force produced by a voltage applied to one or more electrodes which lie in an array above the ink orifices, causing ink to be ejected from selected orifices and to contact a paper receiver. The extent of ejection is claimed to be very small in the above Cielo patents, as opposed to an "ink jet", contact with the paper being the primary means of printing an ink drop. This system is disadvantageous, in that a plurality of high voltages must be controlled and communicated to the electrode array. Also, the electric fields between neighboring electrodes interfere with one another. Further, the fields required are larger than desired to prevent arcing, and the variable characteristics of the paper receiver such as thickness or dampness can cause the applied field to vary.

In U.S. Pat. No. 4,751,531, which issued to Saito, a heater is located below the meniscus of ink contained between two opposing walls. The heater causes, in conjunction with an electrostatic field applied by an electrode located near the heater, the ejection of an ink drop. There are a plurality of heater/electrode pairs, but there is no orifice array. The force on the ink causing drop ejection is produced by the electric field, but this force is alone insufficient to cause drop ejection. That is, the heat from the heater is also required to reduce either the viscous drag and/or the surface tension of the ink in the vicinity of the heater before the electric field force is sufficient to cause drop ejection. The use of an electrostatic force alone requires high voltages. This system is thus disadvantageous in that a plurality of high voltages must be controlled and communicated to the electrode array. Also the lack of an orifice array reduces the density and controllability of ejected drops.

There has been proposed a liquid printing system that affords significant improvements toward overcoming the prior art problems associated with drop size and placement accuracy, attainable printing speeds, power usage, durability, thermal stresses, other printer performance characteristics, manufacturability, and characteristics of useful inks. There is provided a drop-on-demand printing mechanism wherein the means of selecting drops to be printed produces a difference in position between selected drops and drops which are not selected, but which is insufficient to cause the ink drops to overcome the ink surface tension and separate from the body of ink, and wherein an additional means is provided to cause separation of said selected drops from said body of ink. The following table entitled "Drop separation means" shows some of the possible methods for separating selected drops from the body of ink, and ensuring that the selected drops form dots on the printing medium. The drop separation means discriminates between selected drops and un-selected drops to ensure that unselected drops do not form dots on the printing medium.

Drop separation means

| Means | Advantage | Limitation |
|---|---|---|
| 1. Electrostatic attraction | Can print on rough surfaces, simple implementation | Requires high voltage power supply |
| 2. AC electric field | Higher field strength is possible than electrostatic, operating margins can be increased, ink pressure reduced, and dust accumulation is reduced | Requires high voltage AC power supply synchronized to drop ejection phase. Multiple drop phase operation is difficult |
| 3. Proximity (printhead in close proximity to, but not touching, recording medium) | Very small spot sizes can be achieved. Very low power dissipation. High drop position accuracy | Requires print medium to be very close to printhead surface, unsuitable for rough print media, usually requires transfer roller or belt |
| 4. Transfer Proximity (printhead is in close proximity to a transfer roller or belt | Very small spot sizes can be achieved, very low power dissipation, high accuracy, can print on rough paper | Not compact due to size of transfer roller or transfer belt |
| 5. Proximity with oscillating ink pressure | Useful for hot melt inks using viscosity reduction drop selection method, reduces possibility of nozzle clogging, can use pigments instead of dyes | Requires print medium to be very close to printhead surface, not suitable for rough print media. Requires ink pressure oscillation apparatus |
| 6. Magnetic attraction | Can print on rough surfaces. Low power if permanent magnets are used | Requires uniform high magnetic field strength, requires magnetic ink |

The proposed liquid printing system affords significant improvements toward overcoming problems associated with drop size and placement accuracy, attainable printing speeds, power usage, durability, thermal stresses, other printer performance characteristics, manufacturability, and characteristics of useful inks.

An ink jet printer can comprise several systems: the printheads that can utilize one of the above described printing method, an ink delivery system that supplies the ink to the printhead, a printhead transport system that transports the printhead across the page, a receiver transport system that moves receiver medium across the printhead for printing, an image data process and transfer system that provides digital signal to the printhead, a printhead service station that cleans the printhead, and the mechanical encasement and frame that support all above systems.

The ink delivery system in an ink jet printer may exist in several forms. In most page-size ink jet printers, the ink usage is relatively low. The ink is stored in a small cartridge that is attached to, or built in one unit with, the printhead. Examples of the ink cartridges are disclosed in U.S. Pat. Nos. 5,541,632 and 5,557,310. In large format inkjet printers, the ink usage per print is usually high. Auxiliary ink reservoirs are required to store large volumes of ink fluid that are connected to the ink cartridges near the printheads. Examples of auxiliary ink reservoirs are disclosed in European Patents EP 0 745 481 A2 and EP 0 745 482 A2. The level of the ink residual quantity can also be detected. For example, U.S. Pat. No. 5,250,957 discloses an ink detector that senses ink by measuring the electric resistance in the ink.

One problem for ink jet printing is in the variabilities in the physical properties and the chemical compositions in the ink. These variabilities can be caused by ink aging, or mismatching the wrong types of inks to a printer and receiver medium. The variabilities in the ink physical properties and ink chemical compositions compromise the ideal performance of the ink jet printers. For example, print density and color balance can be adversely affected by variations in the physical properties of the ink. These adverse effects can occur within a print, between prints of a given printer, and/or between prints from different printers. Print failures such as in-jet nozzle plugging can also occur as a result of the above described variabilities.

DISCLOSURE OF THE INVENTION

It is an object of the present invention to overcome to the previously described difficulties.

It is another object of the present invention to provide for monitoring ink colorant concentrations for reducing variabilities in color gamut and print densities.

It is still another object of the present invention to provide for detecting ink type during the ink refilling process so that the ink matches the printer and the receiver media for achieving the best print image qualities.

It is yet another object of the present invention to provide for detecting ink type before printing so that the ink matches the printer and the receiver media for achieving the best print image qualities.

In accordance with a feature of the present invention, an ink jet printing apparatus which is adapted to producing images using inks having predetermined concentrations of a magnetic label material therein, includes a printhead, an ink delivery system adapted to provide inks to the printhead, and a magnetic sensor associated with the ink delivery system. The magnetic sensor is sensitive to the magnetic label material in the ink and adapted to produce a signal which is characteristic of the concentration of the label material in the ink. The magnetic sensor includes a permanent magnet and magnetic field sensors having their sensing axes aligned perpendicular to the fixed field of the permanent magnet such that no signal is produced therefrom.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which:

FIG. 1(*b*) is a cross sectional view of a nozzle tip usable in the present invention;

FIG. 1(*c*) is a top view of the nozzle tip of FIG. 1(*b*);

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1A:
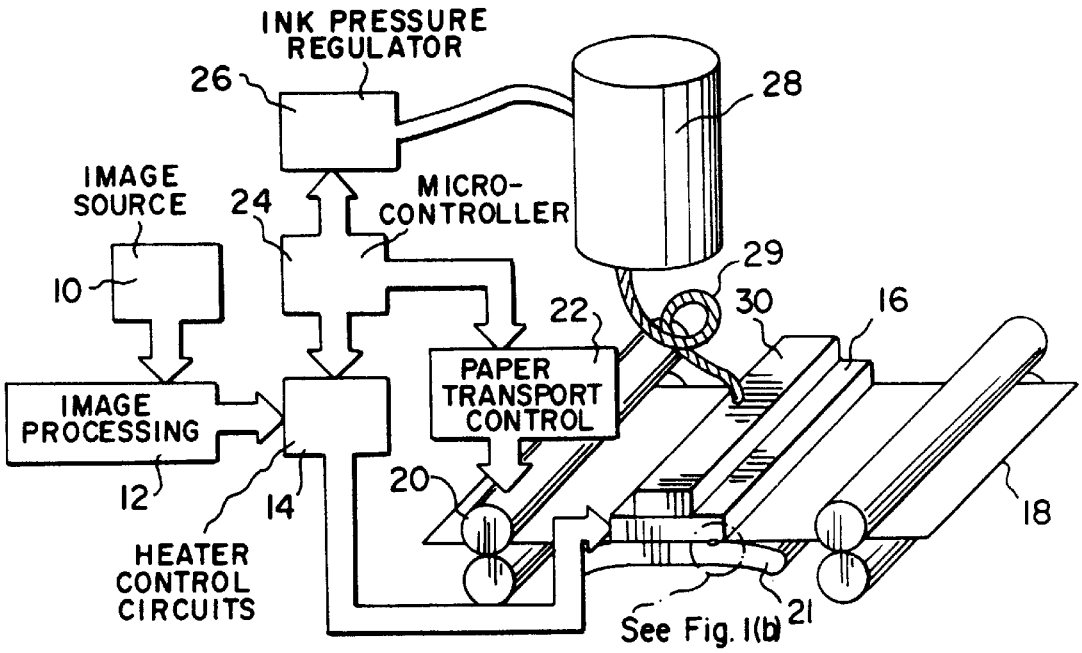
FIG. 1(*a*) shows a simplified block schematic diagram of one exemplary printing apparatus according to the present invention.
Figure 1B:
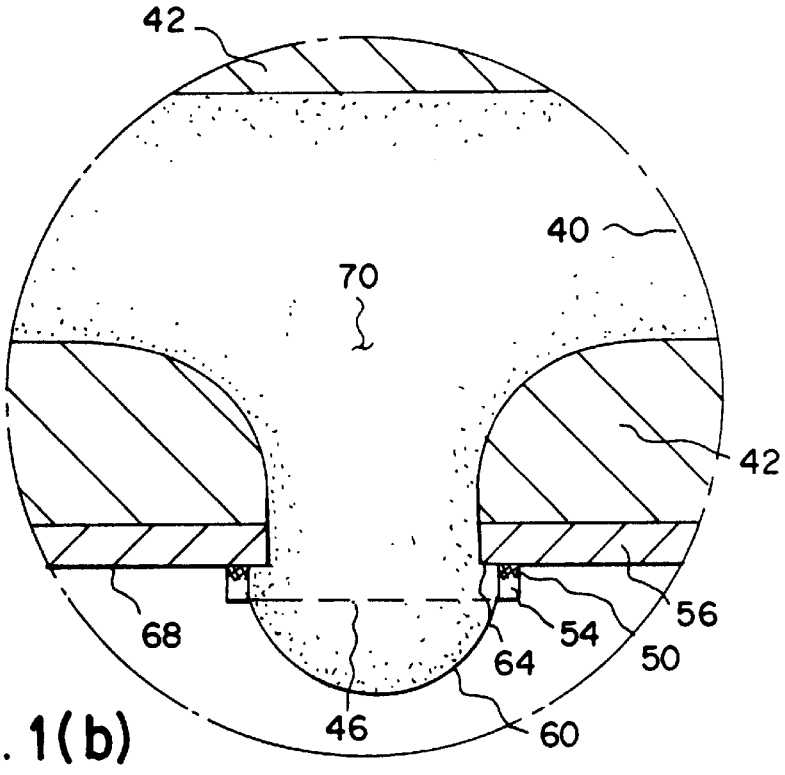

FIG. 1(*a*) is a drawing of an ink transfer system utilizing a printhead which is capable of producing a drop of controlled volume. An image source 10 may be raster image data from a scanner or computer, or outline image data in the form of a page description language, or other forms of digital image representation. This image data is converted by an image processing unit 12 to a map of the thermal activation necessary to provide the proper volume of ink for each pixel. This map is then transferred to image memory. Heater control circuits 14 read data from the image memory and apply time-varying or multiple electrical pulses to selected nozzle heaters that are part of a printhead 16 with backup platen 21. These pulses are applied for an appropriate time, and to the appropriate nozzle, so that selected drops with controlled volumes of ink will form spots on a recording medium 18 after transfer in the appropriate position as defined by the data in the image memory. Recording medium 18 is moved relative to printhead 16 by a paper transport roller 20, which is electronically controlled by a paper transport control system 22, which in turn is controlled by a microcontroller 24.

Microcontroller 24 also controls an ink pressure regulator 26, which maintains a constant ink pressure in an ink reservoir 28 for supply to the printhead through an ink connection tube 29 and an ink channel assembly 30. Ink channel assembly 30 may also serve the function of holding the printhead rigidly in place, and of correcting warp in the printhead. Alternatively, for larger printing systems, the ink pressure can be very accurately generated and controlled by situating the top surface of the ink in reservoir 28 an appropriate distance above printhead 16. This ink level can be regulated by a simple float valve (not shown). The ink is distributed to the back surface of printhead 16 by an ink channel device 30. The ink preferably flows through slots and/or holes etched through the silicon substrate of printhead 16 to the front surface, where the nozzles and heaters are situated.

FIG. 1(*b*) is a detail enlargement of a cross-sectional view of a single nozzle tip of the drop-on-demand ink jet printhead 16 according to a preferred embodiment of the present invention. An ink delivery channel 40, along with a plurality of nozzle bores 46 are etched in a substrate 42, which is silicon in this example. In one example the delivery channel 40 and nozzle bore 46 were formed by anisotropic wet etching of silicon, using a $p^+$ etch stop layer to form the shape of nozzle bore 46. Ink 70 in delivery channel 40 is pressurized above atmospheric pressure, and forms a meniscus 60 which protrudes somewhat above nozzle rim 54, at a point where the force of surface tension, which tends to hold the drop in, balances the force of the ink pressure, which tends to push the drop out.

In this example, the nozzle is of cylindrical form, with a heater 50 forming an annulus. In this example the heater was made of polysilicon doped at a level of about thirty ohms/square, although other resistive heater material could be used. Nozzle rim 54 is formed on top of heater 50 to provide a contact point for meniscus 60. The width of the nozzle rim in this example was 0.6 $\mu$m to 0.8 $\mu$m. Heater 50 is separated from substrate 42 by thermal and electrical insulating layers 56 to minimize heat loss to the substrate.

The layers in contact with the ink can be passivated with a thin film layer 64 for protection, and can also include a layer to improve wetting of the nozzle with the ink in order to improve refill time. The printhead surface can be coated with a hydrophobizing layer 68 to prevent accidental spread of the ink across the front of the printhead. The top of nozzle rim 54 may also be coated with a protective layer which could be either hydrophobic or hydrophilic.

In the quiescent state (with no ink drop selected), the ink pressure is insufficient to overcome the ink surface tension and eject a drop. The ink pressure for optimal operation will depend mainly on the nozzle diameter, surface properties (such as the degree of hydrophobicity) of nozzle bore 46 and rim 54 of the nozzle, surface tension of the ink, and the power and temporal profile of the heater pulse. The ink has a surface tension decrease with temperature such that heat transferred from the heater to the ink after application of an electrothermal pulse will result in the expansion of poised meniscus 60.

For small drop sizes, gravitational force on the ink drop is very small; approximately $10^{-4}$ of the surface tension forces, so gravity can be ignored in most cases. This allows printhead 16 and recording medium 18 to be oriented in any direction in relation to the local gravitational field. This is an important requirement for portable printers.

Figure 2:
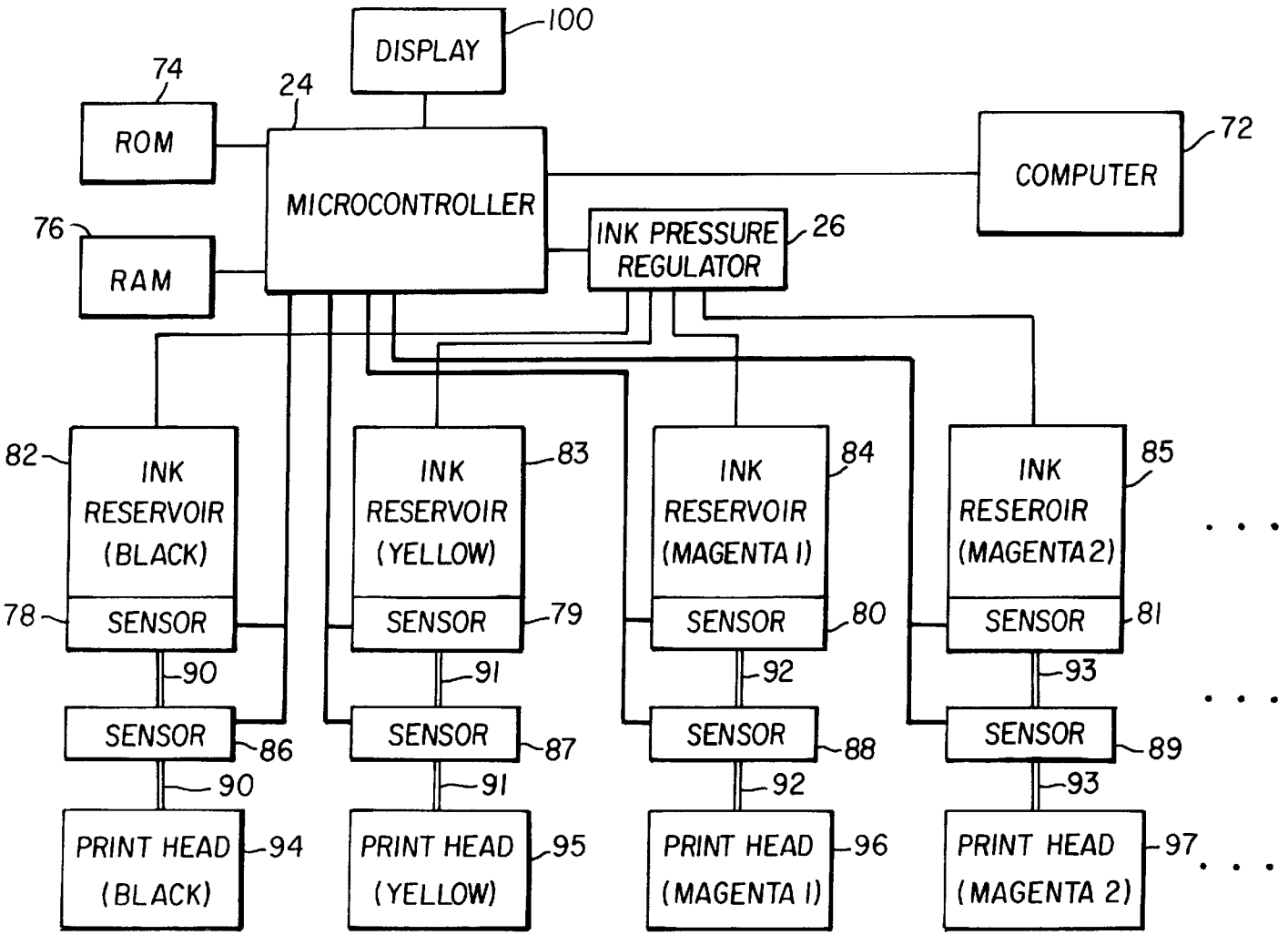
FIG. 2 is a block diagram of the ink delivery system in the present invention.

FIG. 2 illustrates the ink delivery system of a preferred embodiment of the present invention. Microcontroller 24 (also shown in FIG. 1(*a*)) is connected to a computer 72, a Read Only Memory (ROM) 74 a Random Access Memory (RAM) 76, display 100, and ink pressure regulator 26 that regulates the ink pressure in ink reservoirs 28. Microcontroller 24 is also connected to four ink sensors 78–81 that detect predetermined characteristics of the inks in the ink reservoirs 82–85, respectively. Reservoirs 82–85 correspond to reservoir 28 of FIG. 1(*a*). Microcontroller 24 is also connected to four ink sensors 86–89 that detect characteristics of the inks in ink connection tubes 90–93, corresponding to ink connection tube 29 of FIG. 1(*a*). Microcontroller 24 is further connected to the sensors (not shown) in the print heads for detecting the presence as well as the characteristics of the inks in the print heads. The ink jet printer can utilize multiple printheads 94–97, with each printhead connected to one ink reservoir. The ink types include black, yellow, magenta, and cyan colors and can also include several inks within each color. For example, labels "magenta1" and "magenta2" in FIG. 2 can represent magenta inks at different colorant concentrations.

Sensors 78–81 and 86–89 can detect the existence and the colorant concentration in the ink by sensing a detectable label material in the ink. The term "detectable label material" refers herein to an ink ingredient that is added to the ink and is detectable by sensors 78–81 and 86–89 in the ink delivery system. The concentration of the detectable label material to the concentration of the colorant is held as constant in the ink. The detectable label material is, however, not required to perform any other functions in the printhead or on the receiver media. In other words, the ink can achieve desired print qualities without the assistance of the detectable label materials.

One detectable label material which may be used is fine magnetic particles of magnetite $Fe_3O_4$ to produce a black magnetic ink when blended with black pigment and solvent (s). The magnetite particles can be refined in procedures as disclosed in U.S. Pat. No. 4,405,370. The concentration of the magnetic particles is predetermined during manufacture. Details of a black pigmented ink containing a magnetic label material, e.g., is disclosed in commonly assigned, co-pending U.S. patent application Ser. No. 08/846,693 filed concurrently herewith. Magnetic inks exist in many other colors, and may be used in accordance with the present invention. Details of preparation of colored magnetic inks can be found in U.S. Pat. No. 5,506,079.

For achieving the best image quality by an ink jet printing apparatus comprising an ink delivery system as described above, it is most desirable that the label materials do not affect the performance of the inks. For example, the pigment inks often comprise pigment particles smaller than 100 nm in average diameter, which is reported, for example, in "Novel Black Pigment for Ink Jet Ink Applications" by J. E. Johnson and J. A. Belmont, p. 226, in *Recent Progress In Ink Jet Technologies*, published by Society for Imaging Science and Technology. For avoiding increasing the probability of the kogation in the print-head nozzles, as discussed previously, it is therefore desirable for the magnetic particles used as the ink label materials to be smaller than the average diameter of the pigment particles. For most common magnetic particles, however, the magnetic particles are no longer permanent, for lengths smaller than 100 nm $CrO_2$/CoFe, 50 nm Metal Particle, 30 nm BaFe because the particles become unstable due to thermal fluctuations.

The preferred magnetic particle for the ink is Barium Ferrite (BaFeO), because of its small particle size, corrosion resistance, high curie temperature, and high anisotropy field. Small particle size is desirable to avoid kogation in the ink jet printhead. Corrosion resistance is necessary to insure the particles will remain magnetic after long periods of time in water or solvent based inks. High curie temperature and high anisotropy field decrease the lower limit on the size of particles which can be detected by the infield detector system of the invention. Even if some or all of the particles in the ink are smaller than the paramagnetic limit, the detector will still be able to detect them, because the applied field will align the magnetic moments of the particles. The ultimate limit on how small the particles can be and still get a reliable detection depends on the anisotropy field and curie temperature of the material, which is why BaFeO with an anisotropy field of 25,000 Oe and curie point of 600° C. is the preferred particle.

According to the present invention, there is provided a magnetic sensor for ink detection. The magnetic sensor includes a permanent magnet and magnetic field sensors, with their measurement axes aligned perpendicular to the fixed field of the permanent magnet, such that no signal is produced from the large, fixed field of the permanent magnet. The sensor detects the fringing field from induced magnetization in objects or materials placed in proximity to the detector.

This detector utilizes a permanent horseshoe type magnet with two magnetic sensors placed symmetrically between the poles. The signals from the two sensors are subtracted to produce a net output signal. This significantly reduces noise from distant electromagnetic sources, temperature variations, and rotation of the detector in the earth's magnetic field.

An object placed in front of the detector is magnetized by the field of the permanent magnet, and the fringing field from this magnetization is detected by one or both of the magnetic sensors.

Figure 3:
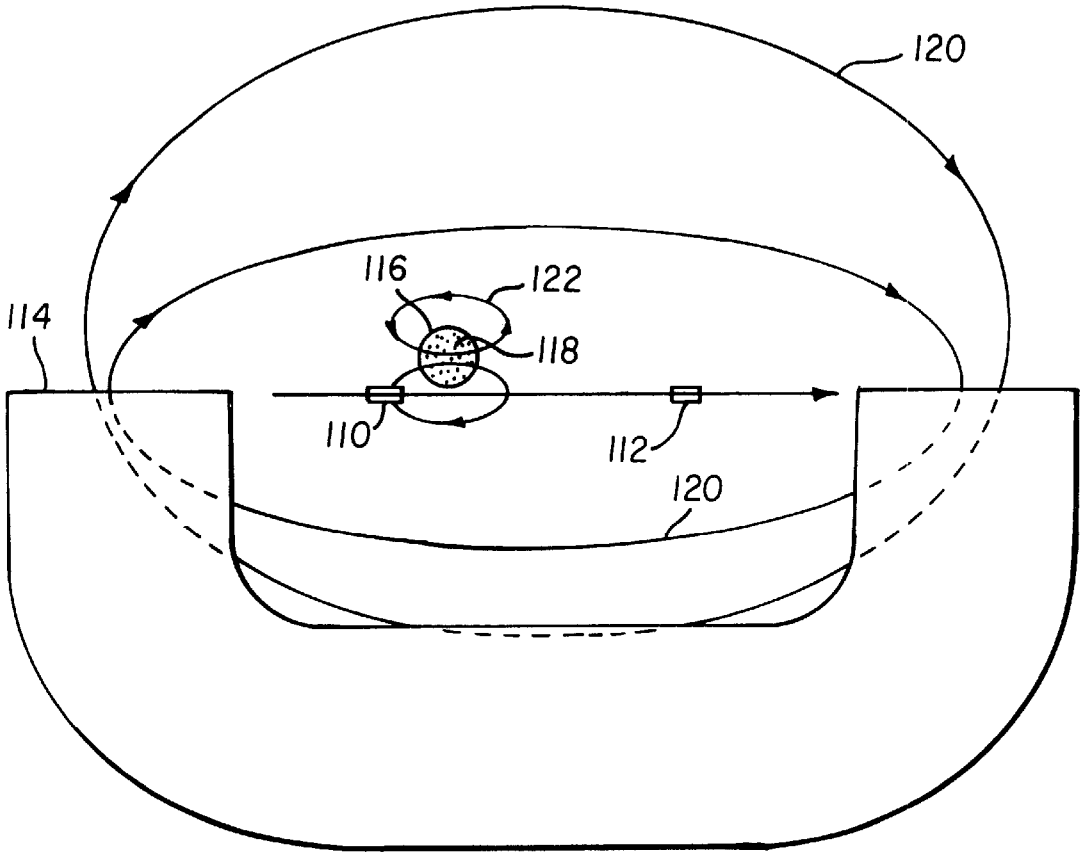
FIG. 3 is a diagrammatic view of an embodiment of the magnetic sensor of the present invention.

The sensor is shown in FIG. 3. Two magnetic sensors 110 and 112 are located between the poles of the magnet 114. These sensors can be of any type which are insensitive to magnetic field along one axis, including but not limited to hall effect sensors, magnetoresistive magnetometers, or flux gate magnetometers. Tube 116 containing ink 118 is positioned close to one of the magnetic sensors 110,112. IF the ink contains magnetic particles, they will be oriented by the field of the magnet and the fringing field detected by the nearby sensor 110,112.

The magnetic field lines 120 from the poles of magnet 114 are schematically represented. Sensors 110 and 112 are aligned perpendicular to the field such that the signal from each is zero. The induced field 122 from magnetic ink 118 is shown, which results in a signal from sensor 110.

In additional embodiment of the invention, the sensors are recessed slightly into gap between the poles of the magnet, and oriented perpendicular tot he fields at their respective locations.

The invention has been described in detail with particular reference to preferred embodiments thereof, but it will be understood that variations and modifications can be effected within the spirit and scope of the invention.

PARTS LIST

10 image source
12 image processing unit
14 heater control circuits
16 printhead
18 recording medium
20 paper transport roller
21 backup platen
22 paper transport control system
24 microcontroller
26 ink pressure regulator
28 ink reservoir
29 ink connection tube
30 ink channel assembly
40 ink delivery channel
42 substrate
46 nozzle bores
50 heater
54 nozzle rim
56 electrical insulating layers
60 meniscus
64 thin film layer
68 hydrophobizing layer
70 ink
72 computer

74 read only memory
76 random access memory
78,79,80,81 ink sensors
82,83,84,85 ink reservoirs
86,87,88,89 ink sensors
90,91,92,93 ink connection tubes
94,95,96,97 multiple printheads
100 display
110,112 magnetic sensors
114 magnet
116 tube
118 ink
120 magnetic field lines
122 induced field

What is claimed is:

1. An ink jet printing apparatus adapted to producing images using inks having a first predetermined concentration of a magnetic label material and a second predetermined concentration of colorant, wherein the ratio of said concentrations is constant therein; said apparatus comprising:

a printhead;

an ink delivery system adapted to provide inks to the printhead; and a magnetic sensor associated with the ink delivery system for measuring the colorant concentration by measuring the magnetic signal produced by sensing the magnetic label material.

2. An ink jet printing apparatus according to claim 1, wherein:

the ink delivery system includes an ink reservoir and an ink flow channel between the ink reservoir and the printhead; and the magnetic sensor is positioned to sense the concentration of the magnetic label material in the ink in the flow channel.

3. An ink jet printing apparatus according to claim 1, wherein:

the ink delivery system includes an ink reservoir and an ink flow channel between the ink reservoir and the printhead; and the magnetic sensor is positioned to sense the concentration of the magnetic label material in the ink reservoir.

4. An ink jet printing apparatus according to claim 1, wherein said magnetic sensors are magnetoresistive, hall effect, or flux gate sensors.

* * * * *